US005746489A

United States Patent [19]

Moon

[11] Patent Number: 5,746,489

[45] Date of Patent: May 5, 1998

[54] DESK FOR COMPUTER SYSTEM

[76] Inventor: Jae-Nyun Moon, 803 Jiwol-ri, Chowol-myun, Kyungki-do, Rep. of Korea

[21] Appl. No.: 646,070

[22] Filed: May 7, 1996

[30] Foreign Application Priority Data

Feb. 27, 1996 [KR] Rep. of Korea ..... 96-4886

[51] Int. Cl.[6] ..... A47B 81/00

[52] U.S. Cl. ..... 312/223.3; 312/7.2; 312/319.5; 312/271

[58] Field of Search ..... 312/27, 30, 21, 312/7.2, 223.3, 319.5, 319.6, 208.1, 271, 194, 196, 273; 108/50, 28, 7, 6, 9, 10, 20, 147; 248/923, 922, 917

[56] References Cited

U.S. PATENT DOCUMENTS

| | | | |
|---|---|---|---|
| 3,203,670 | 8/1965 | Farris | 108/147 X |
| 4,669,789 | 6/1987 | Pemberton | 312/223.3 |
| 4,815,391 | 3/1989 | Lee . | |
| 4,828,342 | 5/1989 | Stefan . | |
| 5,199,773 | 4/1993 | Price, Jr. et al. | 312/7.2 |
| 5,242,217 | 9/1993 | Gonnet | 312/194 |
| 5,364,177 | 11/1994 | Ugalde | 312/223.3 X |
| 5,368,377 | 11/1994 | Baines | 312/27 |
| 5,377,951 | 1/1995 | Johnson et al. | 312/208.1 X |
| 5,474,373 | 12/1995 | Forester . | |

FOREIGN PATENT DOCUMENTS

| | | | |
|---|---|---|---|
| 1241958 | 6/1967 | Germany | 312/208.1 |
| 4009536 | 9/1991 | Germany | 312/223.3 |
| 4100675 | 7/1992 | Germany | 312/30 |
| 740120 | 11/1955 | United Kingdom | 312/30 |

*Primary Examiner*—Peter M. Cuomo
*Assistant Examiner*—Janet M. Wilkens
*Attorney, Agent, or Firm*—Bryan Cave LLP

[57] ABSTRACT

An improved desk for a computer system capable of maximizing the usable surface of the upper surface of the desk by selectively hiding the monitor under the desk, which includes a desk body internally provided with a monitor, the monitor being lifted or lowered; a monitor frame to which the monitor is engaged; a support member for fixing the monitor frame to the desk body; and a driving member for lifting/lowering the monitor frame, so that the monitor can be lifted onto the desk body or lowered under the table in cooperation with the driving member.

18 Claims, 5 Drawing Sheets

DESK FOR COMPUTER SYSTEM

BACKGROUND OF THE INVENTION

1. Field of the Invention

The present invention relates to a desk for a computer by which it is possible to selectively use a desk or a computer desk by providing a monitor, which can be lifted/lowered from/under an upper plate of a desk, and a keyboard support panel which is selectively extendable.

2. Description of the Conventional Art

As well known to those in the art, a computer system includes a computer main body, a monitor, a keyboard, and the like. Here, the above-mentioned elements are placed on a desk or the like, or the computer main body is positioned at a nearby place of the desk. However, at this time, the monitor and the keyboard are placed on the desk.

However, since the computer main body, the monitor, and the keyboard are mounted on the desk at the same time, when a user does not use the computer, the user can not use the upper surface of the desk for another purpose, so that it is possible to more effectively use the upper surface of the desk.

To overcome the above-explained problems, a new technique was introduced in the industry. That is, it is directed to providing a keyboard which is selectively hidden under the desk like a drawer. When using the computer, the keyboard is provided on the upper surface of the desk from the lower portion of the desk. When the computer is not used, the keyboard is hidden under the table, so that it is possible to more effectively use the upper surface of the desk.

However, although the monitor can be selectively hidden under the desk, the monitor is always mounted on the upper surface of the desk, so that it is impossible to more effectively use the upper surface of the desk.

Therefore, in order to overcome the above-explained problems, another technique was introduced in the industry, which is directed to providing a predetermined receiving space in which the monitor can be hidden. That is, when the computer is not used, the monitor is hidden therein, and a transparent window covers the upper portion of the space in which the monitor is hidden, so that the user can effectively use the upper surface of the desk by hiding the monitor under the desk, looking down the monitor through the transparent window.

In this case, although the monitor and the like can be selectively hidden under the desk, and it is possible to more effectively use the upper surface of the desk, when using the computer, the user have to slightly look down toward the screen of the monitor because the monitor is slightly slanted backwardly. That is, the user easily feel a certain panic in his neck because the user have to look down toward the screen of the computer during the operation of the computer.

Furthermore, since the monitor is hidden under the desk, only when the user sits at a chair in front of the screen of the monitor, the user can see the screen of the monitor. In addition, since it is difficult to control the height of the chair and the installation angle of the monitor in accordance with a body features of the user, there is much inconvenience.

Although the desk for a computer system is basically designed for the best arrangement of the monitor, the keyboard, the main body, and the like on the upper surface of the desk. However, when the computer is not used, the desk should be used for other purposes. That is, books, book holder, a telephone, and the like should have to be arranged on the upper surface of the desk for the inherent purpose of the desk.

SUMMARY OF THE INVENTION

Accordingly, it is an object of the present invention to provide a desk for a computer system, which overcomes the problems encountered in a conventional desk for a computer system.

It is another object of the present invention to provide an improved desk for a computer system capable of maximizing the usable surface of the upper surface of the desk by selectively hiding the monitor and the keyboard support panel under the desk.

To achieve the above objects, there is provided a desk for a computer system, which includes a desk body internally provided with a monitor, the monitor being lifted or lowered; a monitor frame to which the monitor is engaged; a support member for fixing the monitor frame to the desk body; and a driving member for lifting/lowering the monitor frame, so that the monitor can be lifted onto the desk body or lowered under the table in cooperation with the driving member.

DETAILED DESCRIPTION OF THE INVENTION

Figure 1:
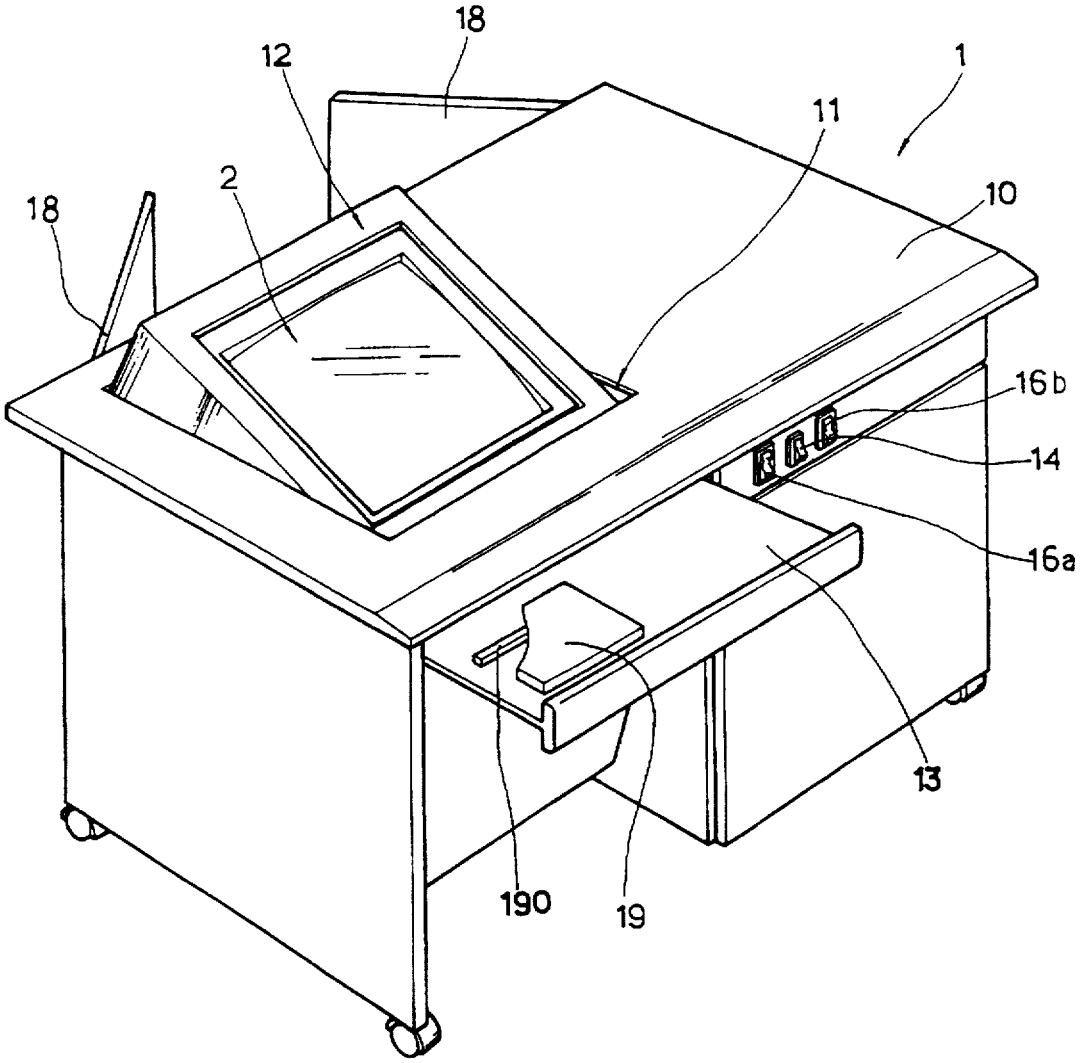
FIG. 1 is a perspective view of a desk for a computer system according to the present invention.

FIG. 1 shows a desk for a computer system according to the present invention.

As shown therein, the desk for a computer system according to the present invention includes a desk body 1 having an upper plate 10 and an opening 11 formed on the upper plate 10 for selectively receiving a monitor 2 therethrough, a rectangular monitor frame 3 into which the monitor 3 is tiltably received and fixed to a certain portion thereof, a supporting member 4 for supporting both sides of the monitor frame 3 to the desk, and a driving member 5 by which the monitor 2 and the keyboard and keyboard support panel 13 are automatically hidden under the desk in accordance with the rotation of the monitor frame 3 which is fixed by the supporting member 4.

In addition, the desk for a computer system according to the present invention further includes a swivel device by which the monitor 2 on the upper surface of the desk can be tiltable in the left/right direction.

The desk body 1 includes an opening 11 which is formed by cutting-away a certain portion of the upper plate 10 and through which the monitor 2 comes out and hidden under the desk, and the opening 11 is covered by a transparent window 12 for protecting eyesight of the user. Here, the transparent window is made of a high quality glass and the like.

A keyboard support panel 13, which is hidden under the desk, is provided immediately below the upper surface of the upper plate 10, and a power switch 14, a driving member 5, and operating switches 16, 16a, and 16b are provided at the side thereof.

A slider 19 which is slidable in the left/right direction in cooperation with a rolling bearing provided at the lower surface thereof or a guide rail 190 is provided at the upper surface of the keyboard support panel 13, so that the keyboard (not shown) is slidable thereon thereby by a predetermined width.

With the above-mentioned construction, the keyboard slidably mounted on the slider 19 can be moved in the left/right direction, so that there can be defined a predetermined portion on the upper surface of the keyboard support panel 13 for a mouse (not shown), and it is possible to prevent the keyboard support panel from being extended from the desk without notice of the user.

In addition, the front wall of the desk body 1 is provided with a door 18 hinged to a predetermined portion of the desk body 1 for opening/closing the front side thereof, and a certain electric cable may be connected to the computer through the door 18.

Figure 2:
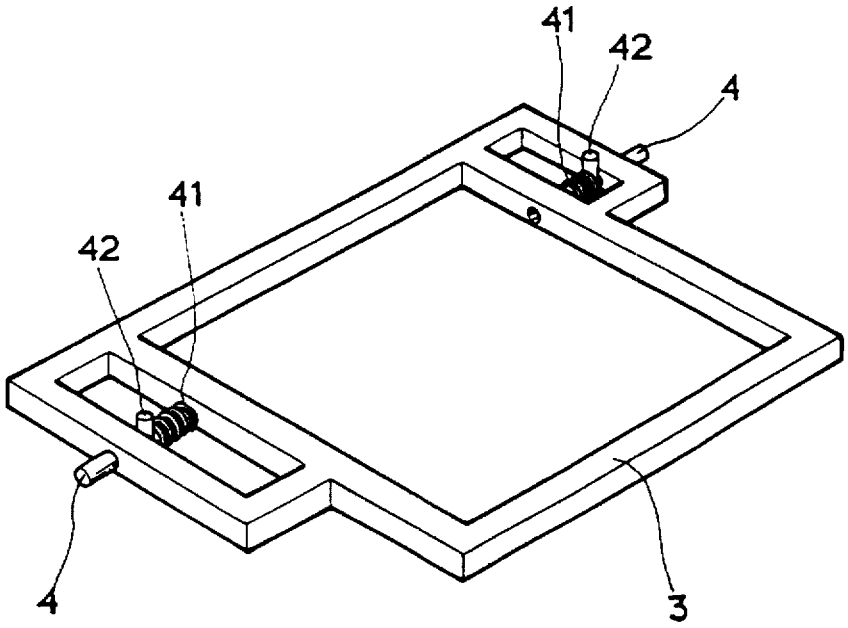
FIG. 2 is a perspective view of a monitor frame of a desk for a computer system according to the present invention.

The monitor 2, as shown in FIG.2, is substantially received into the interior of the monitor frame 3 and tiltably fixed thereto, and the monitor frame 3, to which the monitor 2 is tiltably mounted, is tiltable about the supporting member 4 in cooperation with the driving member 5 which is fixed to the inner wall of the desk body 1 by the supporting member 4.

The supporting member 4 is provided at both sides of the monitor frame 3, to which the monitor is tiltably engaged, and can be slidably pushed in the inner direction of the monitor frame 3. Here, the supporting members 4 receive a certain elastic force by a spring which is disposed at the inner end of each supporting member 4 when the supporting member 4 are inwardly pushed for an easier engagement of the monitor frame 3.

Figure 3:
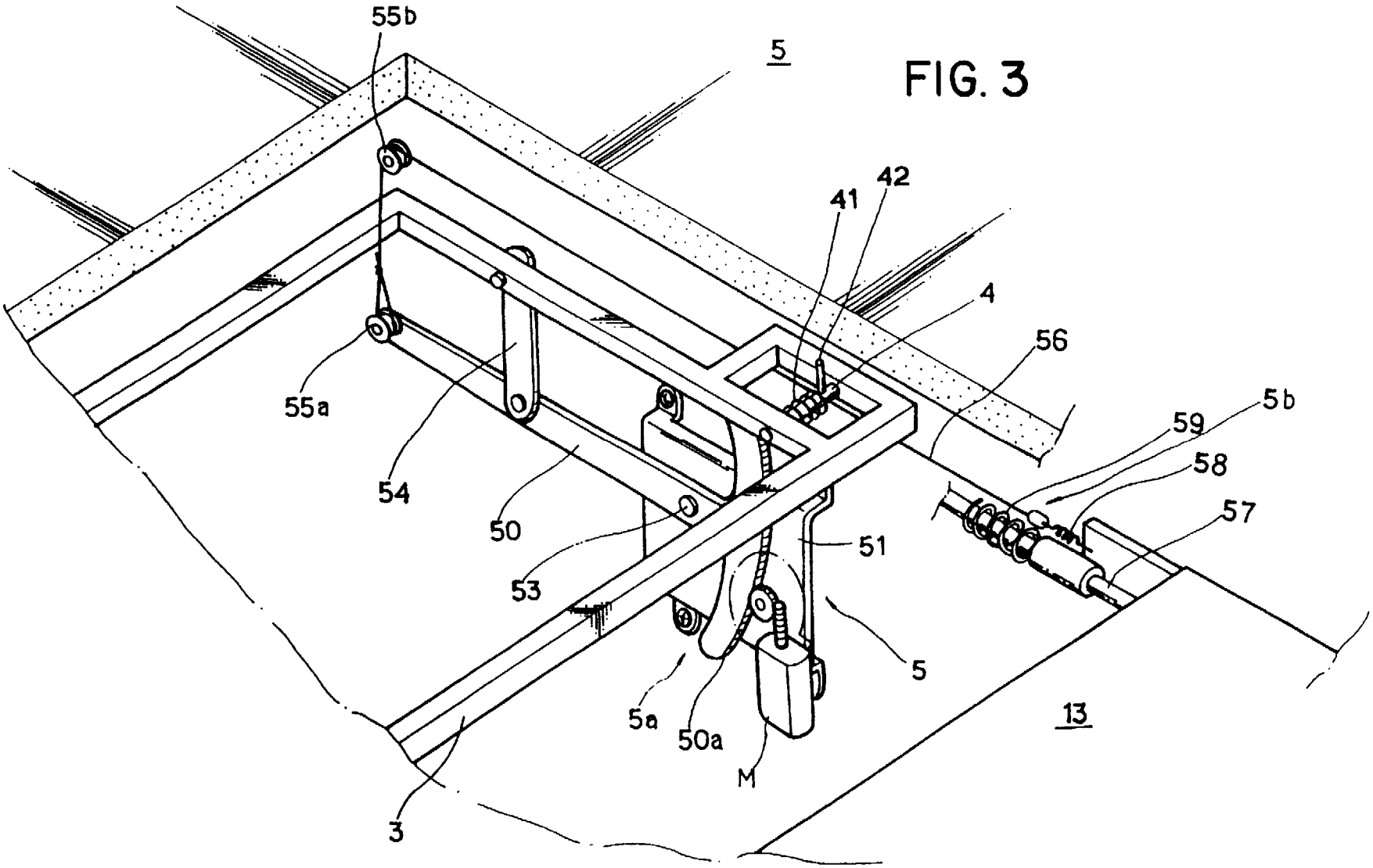
FIG. 3 is a perspective view of one aspect of a driving member for driving a monitor frame of a desk for a computer system according to the present invention.

Therefore, when assembling the monitor frame 3 with the desk body 1, the supporting members 4 are substantially inwardly pushed using a handle 42, provided at a predetermined portion of both the supporting members 4. At this time, the supporting member 4 receives a certain elastic force from the spring 41. Thereafter, the supporting members 4 are inserted into holes formed at both inner walls of the desk body by releasing the handles 42 which are substantially pushed in the inner direction of the monitor frame 3, so that the monitor frame 3 is easily engaged to the desk body 1. As shown in FIG. 3, the monitor frame 3 is tiltable about the supporting member 4.

The driving member 5, which serves to push in the keyboard support panel 13 under the deck body 1 and to pull out the same therefrom includes a monitor driving member **5*a* for lifting/lowering the monitor frame 3 in cooperation with the motor M which is capable of generating a normal rotation force and a reverse rotation force, and a keyboard support driving member 5*b* which serves to push in/pull out the keyboard support panel in cooperation with a driving force of the monitor driving member 5*a*, so that the monitor 2 and the keyboard support panel 13 can be automatically pushed in under the desk body 1** and pulled out from the same.

The monitor driving member **5*a* is fixed to a bracket fixed to an inner wall of the desk body 1 in cooperation with one end of a sector arm 50 as a shaft 53, so that both ends of the sector arm 50 are rotatable about the shaft 53, and the motor M is engaged to a sector gear 50*a* provided at one end portion of the sector arm 50, and the other end of the same is connected with a wire 56 which serves to push in or pull out the keyboard support panel 13**.

In addition, one end of a link 54 disposed at an intermediate portion of the sector arm 50 is connected to the monitor frame 3, so that the monitor 2 can be pushed in and pulled out when the monitor frame 3, connected to the link, is normally rotated or reversely rotated about the supporting member 4 in accordance with a driving of the motor M which is drivingly connected to the sector gear **50*a***.

A keyboard support driving member **5*b* which serves to push in and pull out the keyboard support panel 13 includes a guide rod 57 for slidably guiding the keyboard support panel 13, and a wire 56 which serves to pull and loosen the keyboard support panel 13 which is elastically connected by a spring 59 inserted onto the guide rod 57**.

That is, the keyboard support panel 13 has an outwardly applying elastic force which is generated in cooperation with the spring 59, and is elastically guided by the wire 56. One end of the wire 56 is connected to sector arm 50 of monitor driving member 5a by means of a guide roller **55*a*. The other end of wire 56 is connected to a damping spring 58 fixed to the keyboard support panel 13. Wire 56 is supported by a second guide roller 55*b* on the inner wall of desk body 1. Thus, support panel 13 is automatically pushed in and pulled out when wire 56 is tensioned/released by the sector arm 50 as the sector arm lifts/lowers monitor frame 3**.

The damping spring 58 serves to desirably operate the keyboard support panel 13 which is guided by the wire 56 which is tightened/loosened in cooperation with the sector arm 50.

Meanwhile, the monitor 2, which is exposed to the outside in cooperation with the driving member 5 for rotating the monitor frame 3, has a certain inclination angle when it is mounted on the desk body 1.

Generally, the user sits at a chair and do a computer work while seeing the screen of the monitor. After the user does computer work and desires to do other work the user can rotate the computer monitor to any desired angle. In addition, a rotation swivel device may be attached to the system for further desired rotation of the monitor.

In this case, the swivel device for rotating the monitor serves to rotate the monitor 2 or the monitor frame 3 to which the monitor 2 is engaged at a desired angle (preferably within an angle of about 30° in the left/right direction).

The swivel device may include a driving means such as a rotation toothed member, a normal/reverse rotation motor engaged with the rotation toothed member, a rolling bearing, and a rotation means provided at the upper portion of the monitor frame 3 for rotating the monitor in the left/right direction.

The user can rotate the monitor 2 on the upper surface of the desk body at a desired angle, so that it is convenient to see the screen of the monitor 2 at a proper angle when writing memo and the like.

The operation of the desk for a computer according to the present invention will now be explained with reference to the accompanying drawings.

To begin with, the power switch 14 is turned on, the driving switch 16 is operated, and the sector gear 50a is driven in cooperation with the normal/reverse rotation of the motor M. The sector arm 50 rotates in the normal/reverse direction about the shaft 53, and the link 54 is lifted or lowered.

When the keyboard support panel is unextended under the desk, and the transparent window 12 is at the same plane as the upper plate 10, the sector arm 50 is rotated in the normal direction.

The monitor frame 3 connected to the link 54 which is lifted/lowered in accordance with a rotation movement of the sector arm 50 is rotated about the supporting member 4, and the transparent window 12 and the monitor 2, as shown in FIG. 1, are exposed onto the upper plate 10 through the opening 11. At this time, the wire 56 connected to the other end of the sector arm 50 is loosened, and the keyboard support panel 13 having an elastic force of the spring 59 is extended from the lower portion of the desk body 1.

At this time, the inclination of the monitor 2 engaged into the monitor frame 3 which is lifted/lowered by the driving member 5 is adjusted in cooperation of the switch 16*a*, and the user can freely control the angle of the monitor within a range of 0°~60° in accordance with an operation of the switch 16*a* for a proper sitting pose.

Meanwhile, when the user does not want to use the computer, the sector arm 50 is rotated in the reverse direction when lifting the monitor, and the transparent window 12 is lowered through the opening 11, and the transparent window 12 is at the same plane as the upper plate 10. At the same time, the sector arm 50 pulls the wire 56, and the keyboard support panel 13 is unextended toward the interior of the desk 1.

That is, the desk for a computer system according to the present invention is directed to lifting the monitor and extending the keyboard support panel toward the front side of the desk in cooperation with the driving member which is driven by the normal/reverse rotation motor. When the user does not use the computer, the monitor lifted on the upper plate of the desk and the keyboard support panel are hidden under the desk, so that it is possible to use the upper plate of the desk for the other purpose.

Figure 4:
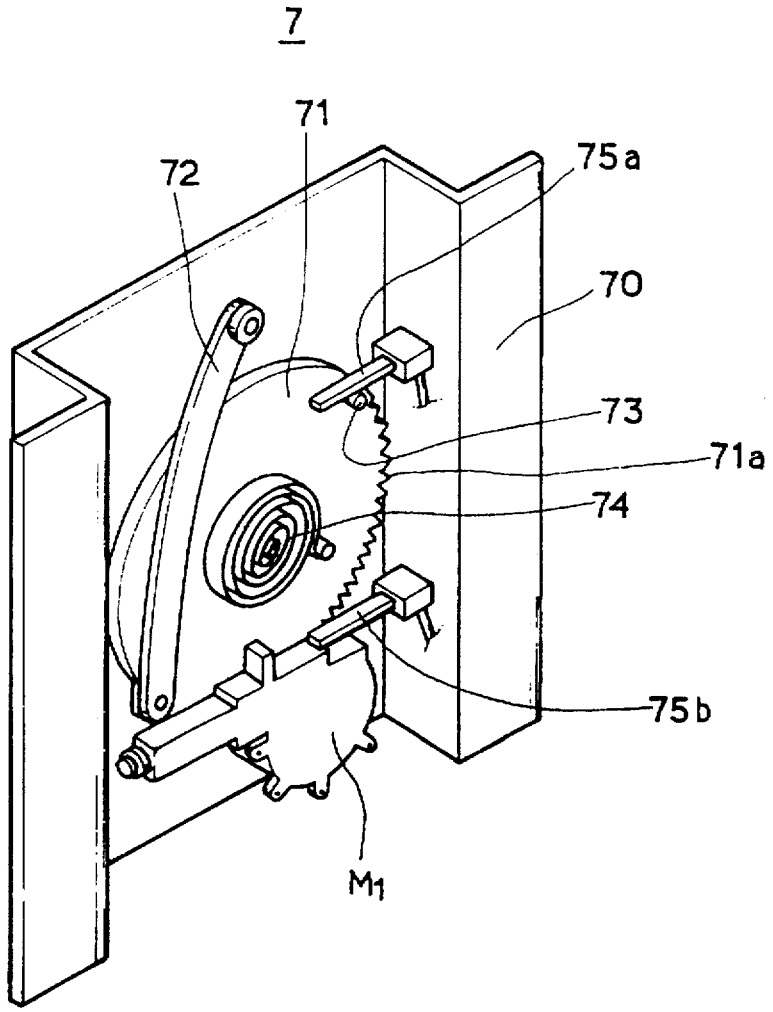
FIG. 4 is a perspective view of another aspect of a driving member for driving a monitor frame of a desk for a computer system according to the present invention.

FIG. 4 shows another aspect of a driving member for driving a monitor frame of a desk for a computer system according to the present invention, which is directed to providing a monitor frame, which is different from the first embodiment of the present invention, for lifting/lowering the monitor frame.

The driving member for driving the monitor frame of a desk for a computer system of FIG. 4 is basically directed to providing a lever 72 fixed to one side of a rotation plate 71 having a geared member 71*a* communicating with a normal/reverse rotation motor M1, so that the monitor frame 3 can be lifted/lowered in a cam driving method which the lever is lifted/lowered in cooperation with the normal/reverse rotation of the rotation plate communicating with the motor M1. That is, the construction thereof is simpler than the previous aspect of the present invention.

The rotation plate 71 is attached to the interior of the bracket 70 disposed at the inner wall of the desk body 1, and is rotatable about the shaft pin, and the normal/reverse rotation motor M1 is engaged to the gear member 71*a* disposed at the outer circumferential portion of the rotation plate 71. A lever 72 and a stopper 73 are connected to the monitor frame 3, and a spiral spring 74 is engaged at the central inner portion thereof.

Upper and lower limit switches 75*a*, 75*b* contacting with the stopper 73 are provided at the bracket 70. With the above-mentioned elements, the motor M1 is controlled by the contact between the stopper 73 and the limit switches 75*a* and 75*b* which are rotated by the rotation plate 71 as the rotation plate 71 is rotated in the normal/reverse direction.

Figure 5A:
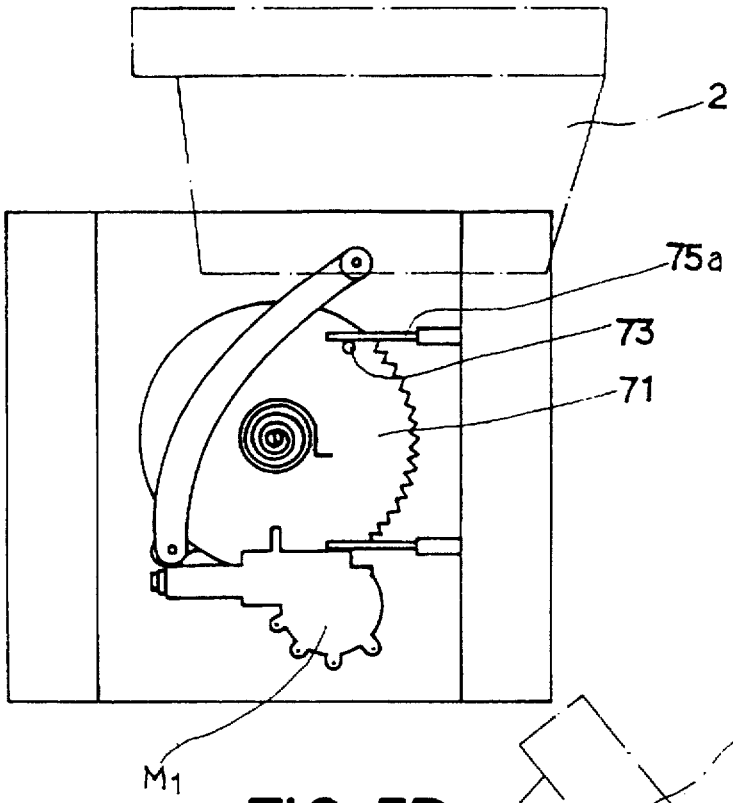
FIGS. 5A and 5B are plan views of a driving member of FIG. 4 so as to show an operation of the same according to the present invention.
Figure 5B:
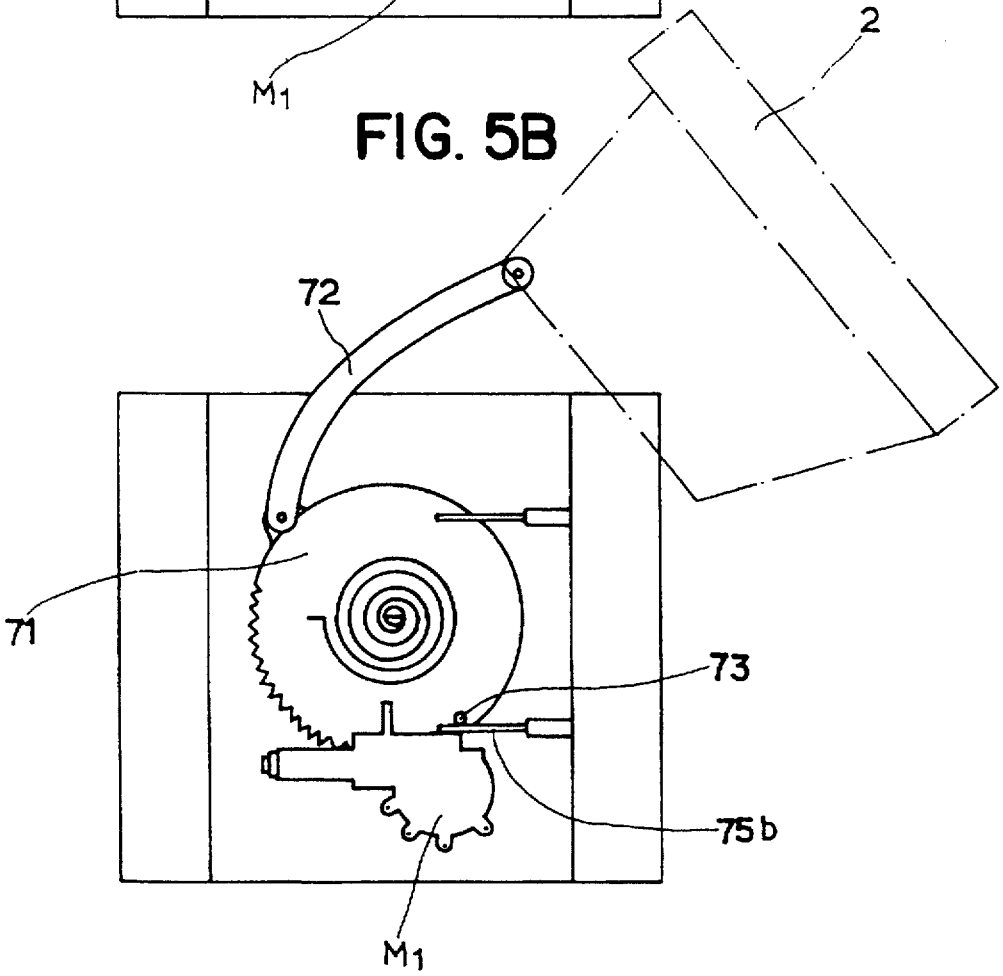

As shown in FIG. 5B, the monitor frame 3 is lifted/lowered by the lever 72 fixed to the rotation plate 71 in accordance with the normal rotation of the rotation plate 71 drivingly engaged with the motor M1. On the contrary, when the rotation plate 71 is rotated in the reverse direction, the monitor frame 3 is lowered as shown in FIG. 5A.

As described above, the desk for a computer system has an advantage in that it is possible to use the upper surface of the desk when the user does not use the computer by lowering the monitor under the upper surface of the desk.

In addition, when using the computer, the monitor is slanted at a predetermined angle, so that the user can see the screen of the monitor in a convenient pose. Moreover, it is possible to prevent any harmful electronic waves generated from the monitor by providing a slanted monitor.

It is possible to adjust the upper and lower installation angle of the monitor in accordance with a user's physical condition, so that it is not necessary to adjust the height of the chair.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A computer desk which comprises:

a computer monitor;

a desk body comprising an upper surface and an interior sized and shaped to receive the computer monitor therein, an opening being formed from the interior through the upper surface;

support means in the interior of the desk body for movably supporting the computer monitor, the support means being rotatable relative to the desk body for extending and retracting the monitor through the opening, the desk body further comprising a pair of axis holes on opposite sides of the support means, the support means comprising supporting members releasably spring biased into the holes to facilitate rotation of the support means:

driving means for lifting/lowering the support means for lifting/lowering the monitor through the opening, whereby in an extended position the monitor is extended through the opening, and in a retracted position the monitor is completely retracted within the interior of the desk body with a viewing portion of the monitor facing the opening; and a transparent window in the plane of the upper surface of the desk body covering the opening when the monitor is in the retracted position, wherein the monitor is visible through the transparent window with the monitor in the retracted position, the transparent window rotating as the monitor is extended through the opening for enabling visibility of the monitor in the extended position.

2. The computer desk in accordance with claim 1, wherein the desk body comprises a drawer-like keyboard support panel movable between an extended position in which the keyboard support panel is extended from the desk body and a retracted position in which the keyboard support panel is retracted into the desk body; and wherein the driving means further comprises means for driving the keyboard support panel to the extended position while lifting the support means to the extended position of the monitor and for driving the keyboard support panel to the retracted position while lowering the support means to the retracted position of the monitor.

3. The computer desk according to claim 12 wherein the driving means comprises:

a reversible motor; and a driving member being driven by the reversible motor for lifting/lowering the support means.

4. The computer desk according to claim 3, wherein the driving member comprises:

a sector arm attached to the support means, the sector arm being drivingly connected to the reversible motor.

5. The computer desk according to claim 3 wherein the driving means further comprises a lever having one end attached to the driving member and a second end attached to the support means.

6. A computer desk which comprises:

a desk body comprising an upper surface and an interior sized and shaped to receive a computer monitor therein, an opening being formed from the interior through the upper surface;

support means in the interior of the desk body for movably supporting a computer monitor, a fixed end of the support means being pivotally mounted to the desk body, the other end of the support means being a free end; and driving means for lifting/lowering the free end of the support means for lifting/lowering the monitor through the opening, whereby in an extended position the monitor is extended through the opening, and in a retracted position the monitor is completely retracted within the interior of the desk body, the driving means comprising a reversible motor and a driving member being driven by the reversible motor for lifting/lowering the support means.

7. The computer desk in accordance with claim 6, wherein the desk body comprises a drawer-like keyboard support panel movable between an extended position in which the keyboard support panel is extended from the desk body and a retracted position in which the keyboard support panel is retracted into the desk body; and wherein the driving means further comprises means for moving the keyboard support panel to the extended position while lifting the support means to the extended position of the monitor and for moving the keyboard support panel to the retracted position while lowering the support means to the retracted position of the monitor.

8. The computer desk according to claim 7 wherein the keyboard support panel moving means comprises:

a keyboard support panel driving member driven by the reversible motor for extending and retracing the keyboard support panel concurrently with the lifting and lowering of the monitor.

9. The computer desk according to claim 8 wherein the driving member comprises:

a sector arm attached to the support means, the sector arm being drivingly connected to the reversible motor, and wherein the keyboard support panel driving member comprises:

a wire extending between the sector arm and the keyboard support panel.

10. The computer desk according to claim 8 wherein the keyboard support panel driving member further comprises:

a guide rod for slidably guiding the keyboard support panel; and spring means for applying an outward biasing force on the keyboard support panel.

11. The computer desk in accordance with claim 6 wherein the desk body comprises a pair of axis holes on opposite sides of the fixed end of the support means, and wherein the support means comprises supporting members releasably spring biased into the holes to facilitate rotation of the support means relative to the desk body.

12. The computer desk according to claim 6 wherein the driving member comprises:

a sector arm attached to the support means, the sector arm being drivingly connected to the reversible motor.

13. The computer desk according to claim 6 wherein the driving means further comprises a lever having one end attached to the driving member and a second end attached to the support means.

14. A computer desk which comprises:

a desk body comprising an upper surface and an interior sized and shaped to receive a computer monitor therein, an opening being formed from the interior through the upper surface;

support means in the interior of the desk body for movably supporting a computer monitor; and driving means for lifting/lowering the support means for lifting/lowering the monitor through the opening, whereby in an extended position the monitor is extended through the opening, and in a retracted position the monitor is completely retracted within the interior of the desk body, the driving means comprising a reversible motor, and i) a sector arm attached to the support means, the sector arm being drivingly connected to the reversible motor, or ii) a driving member rotated by the reversible motor and a lever, the lever having one end attached to the driving member and a second end attached to the support means.

15. A computer desk which comprises:

a desk body comprising an upper surface and an interior sized and shaped to receive a computer monitor therein, an opening being formed from the interior through the upper surface;

support means in the interior of the desk body for movably supporting a computer monitor;

driving means for lifting/lowering the support means for lifting/lowering the monitor through the opening, whereby in an extended position the monitor is extended through the opening, and in a retracted position the monitor is completely retracted within the interior of the desk body;

a drawer-like, keyboard support panel movable between an extended position in which the keyboard support panel is extended from the desk body and a retracted position in which the keyboard support panel is retracted into the desk body; and the driving means further comprises means for concurrently moving the keyboard support panel to the extended position while lifting the support means to the extended position of the monitor and for moving the keyboard support panel to the retracted position while lowering the support means to the retracted position of the monitor.

16. The computer desk according to claim 15 wherein the driving means comprises:

a reversible motor;

a driving member being driven by the reversible motor for lifting/lowering the support means; and a keyboard support panel driving member driven by the reversible motor for extending and retracting the keyboard support panel concurrently with the lifting and lowering of the monitor.

17. The computer desk according to claim 16 wherein the driving member comprises:

a sector arm attached to the support means, the sector arm being drivingly connected to the reversible motor, and wherein the keyboard support panel driving member comprises:

a wire extending between the sector arm and the keyboard support panel.

18. The computer desk according to claim 17 wherein the keyboard support panel driving member further comprises:

a guide rod for slidably guiding the keyboard support panel; and spring means for applying an outward biasing force on the keyboard support panel.

* * * * *